US006174652B1

(12) United States Patent
Chapman et al.

(10) Patent No.: US 6,174,652 B1
(45) Date of Patent: Jan. 16, 2001

(54) STABLE COATING COMPOSITION

(75) Inventors: Derek D. Chapman; Richard C. Van Hanehem, both of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/410,255

(22) Filed: Sep. 30, 1999

(51) Int. Cl.[7] ..... G03C 1/73; G03C 5/16

(52) U.S. Cl. ..... 430/338; 430/201; 430/944; 430/964

(58) Field of Search ..... 430/201, 944, 430/964, 338

(56) References Cited

U.S. PATENT DOCUMENTS 5,011,816 * 4/1991 Byers et al. ..... 430/201
5,866,509 2/1999 Chapman et al. ..... 503/227

* cited by examiner

*Primary Examiner*—Richard L. Schilling
(74) *Attorney, Agent, or Firm*—Harold E. Cole

(57) ABSTRACT

A stable coating composition comprising an image dye, an infrared-absorbing dye, a polymeric binder, an organic solvent and a complexing agent having the following formula:

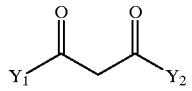

wherein $Y_1$ and $Y_2$ each independently represents an alkyl or fluororalkyl group having from 1 to about 6 carbon atoms, an aryl group having from 6 to about 10 carbon atoms or a hetaryl group having from about 5 to about 10 atoms.

6 Claims, No Drawings

STABLE COATING COMPOSITION

FIELD OF THE INVENTION

This invention relates to use of a complexing agent in a coating composition used in thermal dye transfer imaging which is used to obtain a color proof that accurately represents the hue of a printed color image obtained from a printing press.

BACKGROUND OF THE INVENTION

In order to approximate the appearance of continuous-tone (photographic) images via ink-on-paper printing, the commercial printing industry relies on a process known as halftone printing. In halftone printing, color density gradations are produced by printing patterns of dots or areas of varying sizes, but of the same color density, instead of varying the color density continuously as is done in photographic printing.

There is an important commercial need to obtain a color proof image before a printing press run is made. It is desired that the color proof will accurately represent at least the details and color tone scale of the prints obtained on the printing press. In many cases, it is also desirable that the color proof accurately represent the image quality and halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled.

Colorants that are used in the printing industry are insoluble pigments. By virtue of their pigment character, the spectrophotometric curves of the printing inks are often unusually sharp on either the bathochromic or hypsochromic side. This can cause problems in color proofing systems in which dyes, as opposed to pigments, are being used. It is very difficult to match the hue of a given ink using a single dye.

In U.S. Pat. No. 5,126,760, a process is described for producing a direct digital, halftone color proof of an original image on a dye-receiving element. The proof can then be used to represent a printed color image obtained from a printing press. The process described therein comprises:

a) generating a set of electrical signals which is representative of the shape and color scale of an original image;
b) contacting a dye-donor element comprising a support having thereon a dye layer and an infrared-absorbing material with a first dye-receiving element comprising a support having thereon a polymeric, dye image-receiving layer;
c) using the signals to imagewise-heat by means of a diode laser the dye-donor element, thereby transferring a dye image to the first dye-receiving element; and
d) retransferring the dye image to a second dye image-receiving element which has the same substrate as the printed color image.

In the above process, multiple dye-donors are used to obtain a complete range of colors in the proof. For example, for a full-color proof, four colors: cyan, magenta, yellow and black are normally used.

By using the above process, the image dye is transferred by heating the dye-donor containing the infrared-absorbing material with the diode laser to volatilize the dye, the diode laser beam being modulated by the set of signals which is representative of the shape and color of the original image, so that the dye is heated to cause volatilization only in those areas in which its presence is required on the dye-receiving layer to reconstruct the original image.

In color proofing in the printing industry, it is important to be able to match the proofing ink references provided by the International Prepress Proofing Association. These ink references are density patches made with standard 4-color process inks and are known as SWOP® (Specifications Web Offset Publications) color aims. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p.55.

In U.S. Pat. No. 5,866,509, a magenta dye donor element comprising a mixture of magenta dyes and a yellow dye is described for color proofing. However, a problem has developed using the dye solutions when it is necessary to hold them for a period of time before coating in that the composition of the solutions changes. Thus when a comparison of coatings was made from the fresh solution and the aged solution, the donor made from the aged solution did not have the same speed. Analysis of the aged solution showed that the speed change was caused by decomposition of the IR-absorbing dye which is due to the presence of copper ion in one of the magenta dyes. Cuprous cyanide is used in the synthesis of one of the magenta dyes and it is difficult to remove all traces of copper from the final dye.

It is an object of this invention to provide a coating composition for color proofing which is stable over a period of time

SUMMARY OF THE INVENTION

This and other objects are achieved in accordance with the invention which relates to a stable coating composition comprising an image dye, an infrared-absorbing dye, a polymeric binder, an organic solvent and a complexing agent having the following formula:

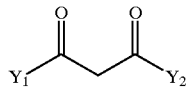

wherein $Y_1$ and $Y_2$ each independently represents an alkyl or fluoroalkyl group having from 1 to about 6 carbon atoms, such as methyl, ethyl, propyl, trifluoromethyl, pentafluoroethyl, etc.; an aryl group having from 6 to about 10 carbon atoms, such as phenyl, tolyl, etc., or a hetaryl group having from about 5 to about 10 atoms, such as thienyl, furyl, etc.

DETAILED DESCRIPTION OF THE INVENTION

In a preferred embodiment of the invention, $Y_1$ and $Y_2$ are each methyl. In another preferred embodiment, $Y_1$ is methyl and $Y_2$ is phenyl. In still another preferred embodiment, $Y_1$ and $Y_2$ are each phenyl. In yet still another embodiment, $Y_1$ is trifluoromethyl and $Y_2$ is 2-thienyl.

Specific examples of complexing agents useful in the invention include the following:

1

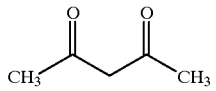

2

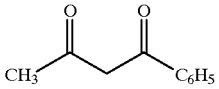

3

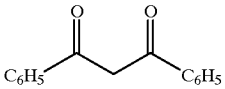

4

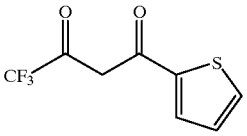

5

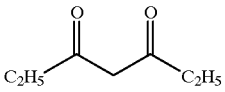

6

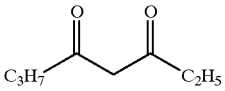

7

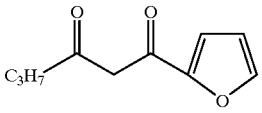

-continued

8

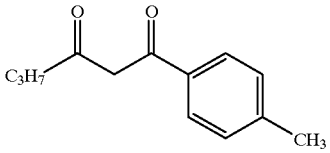

9

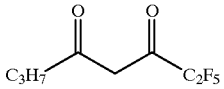

10

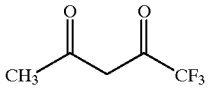

Virtually any image dye that is used in color proofing can be used in the stable coating composition of the invention. For example, there may be employed image dyes as shown in the following U.S. Pat. Nos. 5,079,213; 5,866,509; 5,866,510; 5,041,412 and 5,134,116. During the synthesis or handling of these dyes, unwanted metal impurities may be introduced.

In particular, magenta dyes used in color proofing applications may have copper impurities arising from the synthesis of the dye. In accordance with the invention, a small amount of complexing agent is added to the coating solution and has no deleterious effect on the coating solution. In general, the complexing agents may be used at a concentration of from about 0.1 to about 1% in the coating solution, which is equivalent to about 2 to about 20% by weight in the dry coating.

Magenta dyes that often bring copper impurities in the coating solution include the following:

I

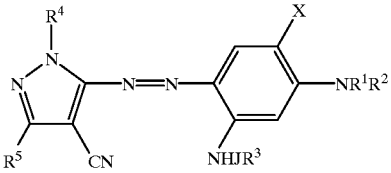

| Dye | $R^1$ | $R^2$ | $R^3$ | $R^4$ | $R^5$ | X | J |
|---|---|---|---|---|---|---|---|
| M-1 | $C_2H_5$ | $C_2H_5$ | $CH_3$ | $CH_3$ | $C_4H_9$-t | $OCH_3$ | CO |
| M-2 | $C_2H_5$ | $C_2H_5$ | $CH_3$ | $CH_2CH—OHCH_3$ | $C_4H_9$-t | $OCH_3$ | CO |
| M-3 | $C_2H_5$ | $C_2H_5$ | $CH_3$ | $CH_2CH—OHC_6H_5$ | $C_4H_9$-t | $OCH_3$ | CO |
| M-4 | $C_2H_5$ | $C_2H_5$ | $C_4H_9$-t | $CH_3$ | $CH_3$ | $OCH_3$ | CO |
| M-5 | $C_2H_5$ | $C_2H_5$ | $CH_3$ | $C_2H_5$ | $C_4H_9$-t | $OC_2H_5$ | $SO_2$ |
| M-6 | $C_2H_5$ | $C_2H_5$ | $C_2H_5$ | $CH_3$ | $CH_3$ | $OC_2H_5$ | CO |
| M-7 | $C_2H_5$ | $C_3H_7$ | $CH_3$ | $CH_3$ | $C_4H_9$-t | $OCH_3$ | CO |
| M-8 | $C_2H_5$ | $C_2H_5$ | $CH_3$ | $CH_3$ | $C_4H_9$-t | $OCH_3$ | $CO_2$ |
| M-9 | $C_2H_5$ | $C_2H_5$ | $C_6H_5$ | $C_3H_7$ | $C_4H_9$-t | $OC_2H_5$ | $SO_2$ |
| M-10 | $CH_2=CH—CH_2$ | $CH_2=CH—CH_2$ | $CH_3$ | $CH_2C_6H_5$ | $C_4H_9$-t | $OCH_3$ | CO |
| M-11 | $C_3H_7$ | $C_3H_7$ | $C_2H_5$ | $C_2H_5$ | $CH_3$ | $OC_3H_7$ | CO |
| M-12 | $C_3H_7$ | $C_3H_7$ | $C_2H_5$ | $C_2H_5$ | $CH_3$ | $OC_3H_7$ | $SO_2$ |

Other specific magenta dyes that often bring copper impurities in the coating solution include the following:

II

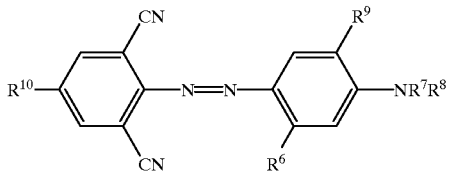

| Compound No | $R^6$ | $R^7$ | $R^8$ | $R^9$ | $R^{10}$ |
|---|---|---|---|---|---|
| M-13 | $NHCOCH_3$ | $C_2H_5$ | $C_2H_5$ | H | $CH_3$ |
| M-14 | $NHSO_2CH_3$ | $C_2H_5$ | $C_3H_7$ | H | $OCH_3$ |
| M-15 | $CH_3$ | $C_2H_5$ | $C_3H_7$ | H | $OCH_3$ |
| M-16 | $NHSO_2CH_3$ | $C_3H_7$ | $C_3H_7$ | H | $CH_3$ |
| M-17 | $NHSO_2CH_3$ | $C_2H_5$ | $C_2H_5$ | H | $CH_3$ |
| M-18 | $NHCOCH_3$ | $CH_2CH_2OH$ | $C_3H_7$ | H | $OCH_3$ |

A yellow dye is usually included with a magenta dye mixture in order to increase the amount of blue absorption and to adjust the colorimetry to match the magenta SWOP color aim. Such yellow dyes may have the following structures:

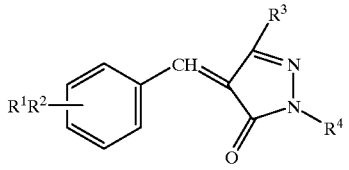

| Compound No. | $R^1$ | $R^2$ | $R^3$ | $R^4$ |
|---|---|---|---|---|
| Y-1 | 3-$CH_3O$ | 4-$CH_3O$ | $CH_3$ | $C_6H_5$ |
| Y-2 | 3-$CH_3O$ | H | $CH_3$ | $C_6H_5$ |
| Y-3 | H | 4-$CH_3O$ | $CH_3$ | $C_6H_5$ |
| Y-4 | 3-$CH_3$ | 4-$CH_3O$ | $CH_3$ | $C_6H_5$ |
| Y-5 | 3-$CH_3$ | 4-$CH_3$ | $CH_3$ | $C_6H_5$ |
| Y-6 | 3-$CH_3$ | 4-$CH_3$ | $CH_3O$ | $CH_3$ |
| Y-7 | 3-$CH_3$ | 4-$CH_3$ | $CH_3O$ | $C_6H_5$ |
| Y-8 | H | 4-$CH_3O$ | $CH_3O$ | $C_2H_5$ |

The binder in the coating composition of the invention may include a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(vinyl acetate); poly(styrene-co-acrylonitrile); a polysulfone or a poly(phenylene oxide). The binder may be used at a coverage of from about 0.1 to about 5 $g/m^2$.

Organic solvents useful in the coating composition of the invention include the following: propyl acetate, propanol, methyl isobutyl ketone, ethanol, 1-methoxy-2-propanol, diethyl ketone, etc.

The coating composition of the invention is used to make a dye-donor element for laser color-proofing. A laser is used to transfer dye from a dye-donor element coated with the coating composition of the invention. It is preferred to use a diode laser since it offers substantial advantages in terms of its small size, low cost, stability, reliability, ruggedness, and ease of modulation. In practice, before any laser can be used to heat a dye-donor element, the element must contain an absorbing material which absorbs at the emitting wavelength of the laser. When an infrared laser is employed, then an infrared-absorbing material may be used, such as carbon black, cyanine infrared-absorbing dyes as described in U.S. Pat. No. 4,973,572, or other materials as described in the following U.S. Pat. Nos. 4,948,777; 4,950,640; 4,950,639; 4,948,776; 4,948,778; 4,942,141; 4,952,552; 5,036,040; and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Typical IR dyes which may be used in the invention include the following: cyanine infrared-absorbing dyes as described in U.S. Pat. No. 4,973,572, or other materials as described in the following U.S. Pat. Nos. 4,948,777; 4,950,640; 4,950,639; 4,948,776; 4,948,778; 4,942,141; 4,952,552; 5,036,040; and 4,912,083, the disclosures of which are hereby incorporated by reference. Other IR dyes useful in the invention include the following:

Dye A

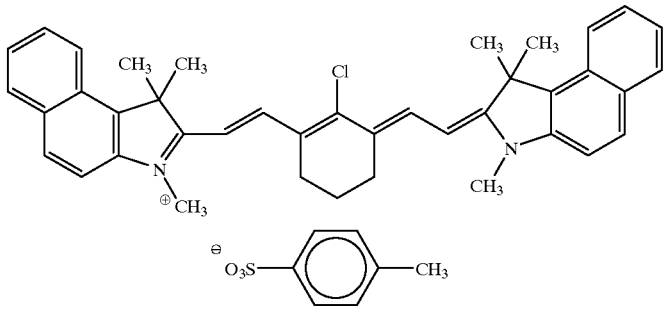

-continued

Dye B

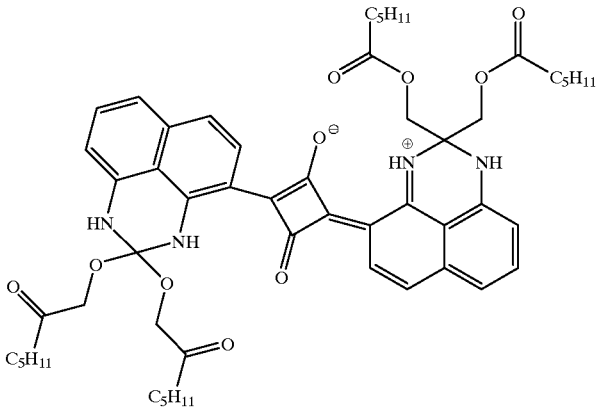

Dye C

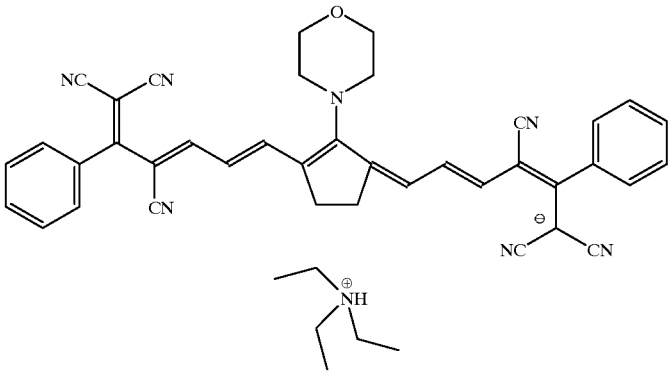

Dye D

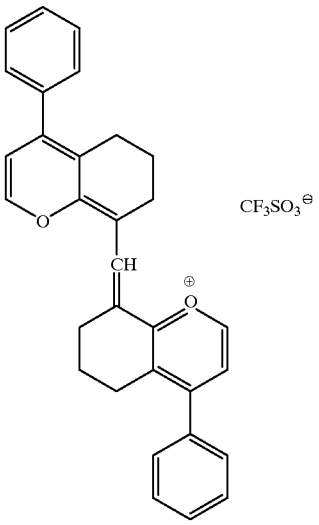

The following examples are provided to illustrate the invention.

EXAMPLES

Example 1

Coating Solution with Binder

The stabilizing effect of complexing agent 1 (0.5 wt. %) was tested on a coating solution containing 0.802 wt. % of magenta dye M-16, 0.235 wt. % of yellow dye Y-1, 1.255 wt. % of magenta dye M-2, 0.24 wt. % of the cyanine infrared-absorbing dye A and 2.3 wt. % of cellulose acetate propionate binder.

The infrared dye that is present in the coating solution was affected by the copper impurity in the magenta dye M-16. The above solution was analyzed spectrophotometrically to determine the presence of the infrared-absorbing dye at various time intervals. The following results were obtained:

TABLE 1

| Complexing Agent (wt. %) | Amount of Cyanine IR Dye A Initially | After 2 days | After 2 weeks |
|---|---|---|---|
| None | 0.24 | 0.21 | 0.19 |
| 1 (0.5) | 0.24 | 0.24 | 0.24 |

The above results show that there was a gradual reduction in the amount of the IR Dye A over a 2-week period, whereas a solution containing 0.5 wt. % of the complexing agent 1 showed no loss over a 2 week period.

Example 2

Model Solutions Without Binder

A stock solution (S1) of magenta dye M-2 and copper acetate monohydrate were dissolved in methyl isobutyl ketone and ethyl alcohol (70/30 wt./wt. ratio) at 0.55 wt. % and 0.021 wt. %, respectively. A second stock solution (S2) was prepared in the same way except that this stock solution contained 0.5 wt. % of complexing agent 1 in addition to the magenta dye and copper acetate.

Infrared dyes of structures shown below were added to aliquots of these stock solutions (both S1 and S2) at levels between 0.20 and 0.46 wt. %. The level varied depending on the molar absorptivity of the IR dye. The visible spectrum between 200 and 1100 nm of a diluted aliquot of each solution was measured and recorded. The samples were kept in sealed vials for two days at room temperature and then reanalyzed spectrophotometrically.

The results are shown in Table 2 as the normalized ratio of infrared absorbance (wavelength of maximum absorption varies between 801 and 862 nm depending on IR dye) to magenta dye absorbance at 555 nm. The ratio at time the start of the experiment is normalized to 1.0. The change in this ratio is expressed as a fraction of infrared dye remaining.

TABLE 2

| IR Dye | Stock Solution | Normalized Amount of IR Dye Remaining After 2 Days |
|---|---|---|
| A | 1 | 0.62 |
| A | 2 | 0.92 |
| B | 1 | 0.77 |
| B | 2 | 0.97 |
| C | 1 | 0.18 |
| C | 2 | 0.73 |
| D | 1 | 0.56 |
| D | 2 | 0.73 |

The above results show that when the complexing agent 1 is present in accordance with the invention, the infrared dyes are more stable in comparison to the controls for each infrared dye without stabilizer.

Example 3

Model Solutions Without Binder

A stock solution containing 0.55 wt. % magenta dye M-2 and 0.21 wt. % copper acetate monohydrate in methyl isobutyl ketone and ethyl alcohol (70/30 wt./wt. ratio) was prepared. To aliquots of this stock solution were added one of the following infrared-absorbing dyes: B (0.38 wt. %), C (0.21 wt. %), and D (0.46 wt. %). The level of IR dye depended on its molar absorptivity. Duplicate solutions of each IR dye in stock solution were prepared. To one of the solutions containing IR dye B, 0.5 wt. % of complexing agent 4 was added. To one of the solutions containing IR dye C, 0.5 wt. % of complexing agent 2 was added. To one of the solutions containing IR dye D, 0.5 wt. % of complexing agent 3 was added.

The visible spectrum between 200 and 1100 nm of a diluted aliquot of each solution was measured and recorded. These solutions were kept for two days at room temperature and the ratio of IR dye to magenta dye determined spectrophotometrically as before. Magenta dye M-2 was used as the internal reference. The results are shown in Table 3 as the normalized ratio of IR dye to magenta dye remaining. The initial ratio is normalized to 1.0. The change in this ratio is expressed as a fraction of infrared dye remaining.

TABLE 3

| IR Dye | Stabilizer | Normalized Amount of IR Dye Remaining After 2 Days |
|---|---|---|
| B | None | 0.79 |
| B | 4 | 0.99 |
| C | None | 0.05 |
| C | 2 | 0.87 |
| D | None | 0.67 |
| D | 3 | 0.81 |

The above results show that the stabilizers enhance the stability of the infrared-absorbing dyes compared to their controls.

The invention has been described in detail with particular reference to preferred embodiments thereof, but it will be understood that variations and modifications can be effected within the spirit and scope of the invention.

What is claimed is:

1. A stable coating composition comprising an image dye, an infrared-absorbing dye, a polymeric binder, an organic solvent and a complexing agent having the following formula:

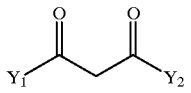

wherein $Y_1$ and $Y_2$ each independently represents an alkyl or fluororalkyl group having from 1 to about 6 carbon atoms, an aryl group having from 6 to about 10 carbon atoms or a hetaryl group having from about 5 to about 10 atoms.

2. The composition of claim 1 wherein said complexing agent is present in said composition an amount of from about 0.1 to about 1% by weight.

3. The composition of claim 1 wherein $Y_1$ and $Y_2$ are each methyl.

4. The composition of claim 1 wherein $Y_1$ is methyl and $Y_2$ is phenyl.

5. The composition of claim 1 wherein $Y_1$ and $Y_2$ are each phenyl.

6. The composition of claim 1 wherein $Y_1$ is trifluoromethyl and $Y_2$ is 2-thienyl.

* * * * *